US008381482B2

(12) United States Patent
Lin et al.

(10) Patent No.: US 8,381,482 B2
(45) Date of Patent: Feb. 26, 2013

(54) ANCHOR BOLT LOCATOR

(75) Inventors: Jin-Jie Lin, Livermore, CA (US); Timothy S. Ellis, Thousand Oaks, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 13/194,805

(22) Filed: Jul. 29, 2011

(65) Prior Publication Data

US 2013/0025234 A1 Jan. 31, 2013

(51) Int. Cl.
*E02D 27/32* (2006.01)
*E04C 5/00* (2006.01)

(52) U.S. Cl. ..... 52/699; 52/295; 52/677

(58) Field of Classification Search ..... 52/699, 52/700, 701, 677, 295, 698
See application file for complete search history.

(56) References Cited

U.S. PATENT DOCUMENTS

| | | | | |
|---|---|---|---|---|
| 991,517 | A | | 5/1911 | Kennedy |
| 1,045,562 | A | | 11/1912 | Kennedy |
| 1,108,859 | A | | 8/1914 | Bennet |
| 1,185,765 | A | | 6/1916 | Brooks |
| 1,264,189 | A | | 4/1918 | Keator |
| 1,447,515 | A | | 6/1922 | Miller |
| 1,726,286 | A | | 8/1929 | Bennet |
| 1,940,545 | A | | 12/1931 | Holmes |
| 2,625,815 | A | | 1/1953 | Black |
| 3,157,966 | A | | 11/1964 | Sherburne |
| 3,391,514 | A | | 7/1968 | Hall, Jr. |
| 3,405,497 | A | | 10/1968 | McNair |
| 3,418,781 | A | | 12/1968 | Penote |
| 3,443,351 | A | | 5/1969 | Kumazawa |
| 3,514,917 | A | | 6/1970 | Merrill, Sr. |
| 3,867,804 | A | | 2/1975 | Wilson |
| 3,884,004 | A | | 5/1975 | Douma et al. |
| 3,927,497 | A | | 12/1975 | Yoshinaga et al. |
| 4,000,591 | A | | 1/1977 | Courtois |
| 4,169,569 | A | | 10/1979 | Riegler et al. |
| 4,195,709 | A | | 4/1980 | Gianotti et al. |
| 4,287,807 | A | | 9/1981 | Pacharis et al. |
| 4,325,575 | A | | 4/1982 | Holt et al. |
| 4,408,940 | A | | 10/1983 | Fischer |
| 4,412,407 | A | | 11/1983 | Melfi et al. |
| 4,641,478 | A | * | 2/1987 | Nelson, Jr. ..... 52/704 |
| 4,945,704 | A | | 8/1990 | Brown, Jr. |
| 5,050,364 | A | | 9/1991 | Johnson et al. |
| 5,085,547 | A | | 2/1992 | Vanotti |
| 5,205,690 | A | | 4/1993 | Roth |
| 5,375,384 | A | | 12/1994 | Wolfson |
| 5,641,256 | A | | 6/1997 | Gundy |

(Continued)

OTHER PUBLICATIONS

Lumberlok Engineered Metal Fasteners Catalog, 1988, p. 3 and back cover, Lumberlok, Hayward, California, United States.

(Continued)

*Primary Examiner* — Robert Canfield
*Assistant Examiner* — Brent W Herring
(74) *Attorney, Agent, or Firm* — James R. Cypher; Charles R. Cypher

(57) ABSTRACT

An anchor bolt locator is provided that is inexpensively manufactured on automatic die-press machines from sheet steel and a structural nut that does not require any welding, while also being easy to use and install with current, commonly-used building practices and anchor designs. The anchor bolt locator is made from a galvanized sheet metal chair and a structural nut attached to the chair by way of a friction fit.

5 Claims, 7 Drawing Sheets

U.S. PATENT DOCUMENTS

| | | | | |
|---|---|---|---|---|
| 5,653,078 | A | | 8/1997 | Kies et al. |
| 5,653,563 | A | | 8/1997 | Ernst et al. |
| 5,740,651 | A | | 4/1998 | Vanotti |
| 5,772,372 | A | | 6/1998 | Lins et al. |
| 5,957,644 | A | | 9/1999 | Vaughan |
| 6,079,179 | A | * | 6/2000 | Shoemaker, Jr. ..... 52/699 |
| 6,161,339 | A | | 12/2000 | Cornett, Sr. et al. |
| 6,240,697 | B1 | | 6/2001 | Thompson et al. |
| 6,341,452 | B1 | | 1/2002 | Billinghaus |
| 6,350,093 | B1 | | 2/2002 | Petersen et al. |
| 6,513,300 | B1 | | 2/2003 | James |
| 7,150,132 | B2 | | 12/2006 | Commins |
| 7,174,679 | B1 | | 2/2007 | Mueller |
| 7,296,382 | B2 | | 11/2007 | Sack |
| 7,445,192 | B2 | | 11/2008 | Gridley et al. |
| 7,946,086 | B2 | | 5/2011 | Hammer et al. |
| 7,971,411 | B2 | | 7/2011 | Commins |
| 2002/0189175 | A1 | | 12/2002 | Lecelot, III et al. |
| 2011/0041449 | A1 | | 2/2011 | Espinosa |
| 2011/0041450 | A1 | | 2/2011 | Espinosa |

OTHER PUBLICATIONS

KC Metals Superspeed Connectors Catalog, at least as early as Apr. 2011, front cover, p. 76 and back cover, KC Metals Products, Inc., San Jose, California, United States.

* cited by examiner

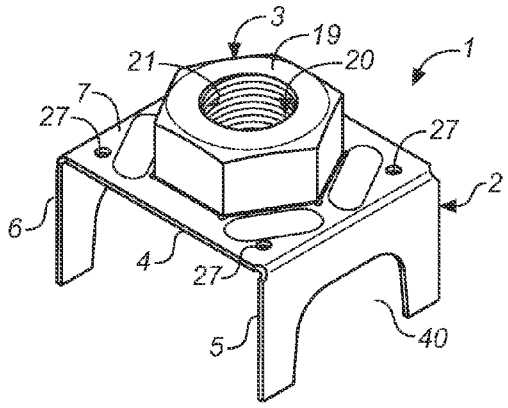
FIG. 1A
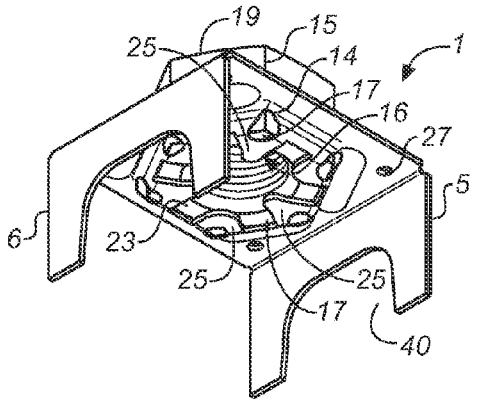
FIG. 1B
FIG. 1C
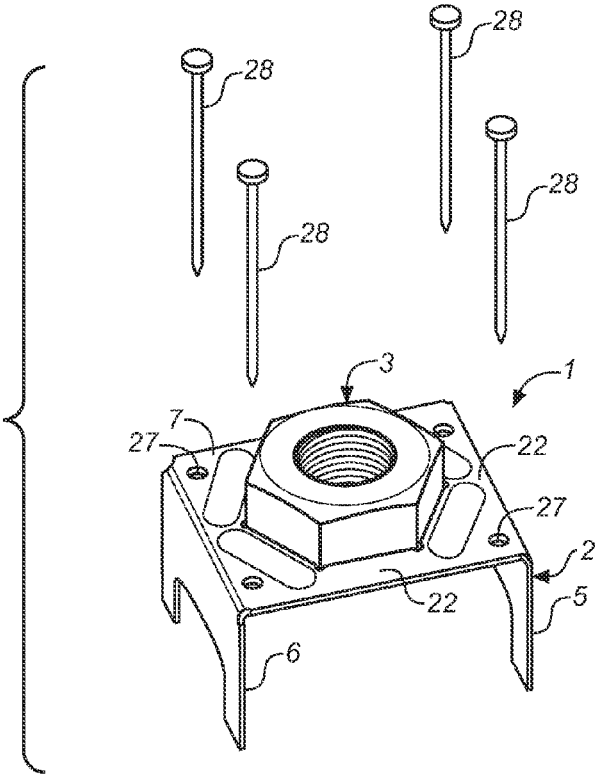

ANCHOR BOLT LOCATOR

BACKGROUND OF THE INVENTION

The present invention relates to a concrete embedded insert, called an anchor bolt locator, for properly locating and supporting a bolt or anchoring member during the pouring and curing of a concrete member, such that bolt will be properly placed in the cured concrete.

A concrete slab member is a common structural element of modern buildings. Horizontal slabs of steel-reinforced concrete are used to construct slab foundations, floors, ceilings, decks and exterior paving.

Concrete slabs are built using formwork—a type of boxing into which the wet concrete is poured. Typically, if the slab is to be reinforced, steel reinforcing rods are used, and these are positioned within the formwork before the concrete is poured. This steel reinforcing is often called rebar. Plastic tipped metal, or plastic bar chairs are typically used to hold the reinforcing rods away from the bottom and sides faces of the formwork, so that when the concrete sets it completely envelops the reinforcing rods. For a slab resting on the ground, the formwork may consist only of sidewalls pushed into the ground. For a suspended slab, the formwork is shaped like a tray, often supported by a temporary scaffold until the concrete sets. The formwork is commonly built from wooden planks and boards, plastic, or steel. After the concrete has set the formwork can be removed or remain in place. In some cases formwork is not necessary—for instance, a ground slab surrounded by brick or block foundation walls, where the walls act as the sides of the tray and the hardcore earth acts as the base.

Concrete slab members are also typically built in a manner that allows for anchor members and fasteners to be built into the slab so that other building elements can be easily and securely anchored to the concrete member. It is very common to see a slab with many different bolts and fasteners protruding from the slab after it has cured and the formwork has been removed. These preset anchors or inserts are typically used for securing pipes or conduits to concrete ceilings, or for securing framing to a concrete foundation or floor.

When anchors such as bolts and threaded rod are to be embedded in a concrete slab, they must be supported during the concrete pour. It is important that the anchors are located properly in the slab and remain undisturbed during the pour, so that subsequent building elements can be attached to them properly. The proper location of anchors in slabs is especially important for decks where the anchor will fasten a safety railing to the deck and for lateral force resisting systems where the anchors must be placed carefully to provide the proper anchorage without interfering with other structural members. Proper location is also important for the integrity of the anchor and the strength of the anchorage. If the anchor is set too close or at an improper angle so that it is too close to the sides of the slab water penetrating into the slab can degrade the anchor, and the strength of the anchorage is also compromised if there is insufficient concrete surrounding the anchor.

Typically, certain of the anchors located in the slab will be located close enough to the edges of the slab that they can be supported by a member attached to the side formwork during the pour. Other anchors will be located sufficiently far away from the sides of the form that they must be supported in some other manner. Sometimes the anchors can be tied to and supported by the reinforcing rods. Other times it is preferable to support the anchor on the underlying surface of the formwork. The present invention is a free-standing anchor bolt locator that attaches to the underlying formwork and holds an anchor or bolt during the concrete pour. Many such devices appear in the patent literature, including: U.S. Pat. No. 5,957,644, granted Sep. 28, 1999, to James A. Vaughan, U.S. Pat. No. 5,050,364, granted Sep. 24, 1991, to Michael S. Johnson et. al., and U.S. Pat. No. 5,205,690, granted Apr. 27, 1993, to Steven Roth.

The present invention improves upon the prior art by providing an anchor bolt locator that is inexpensively manufactured on automatic die-press machines from sheet steel and a structural nut that does not require any welding, while also being easy to use and install with current, commonly-used building practices and anchor designs.

SUMMARY OF THE INVENTION

It is an object of the present invention is to provide an anchor bolt locator, and a method for making an anchor bolt locator that is economically efficient to produce. It is also an object of the present invention to provide an anchor bolt locator that is easy to use and install. These objects are achieved by forming the chair of the anchor bolt locator out of sheet metal, and forming the anchor bolt locator in such a way that a structural nut can be permanently attached to the sheet metal chair without having to weld the nut to the chair. In this manner an anchor bolt locator is formed that can receive a piece of threaded rod in the nut in the typical fashion currently used for creating threaded rod anchorages with the nut at the proper height for such an anchorage. This type of anchorage is typical in the industry and uses two structural nuts sandwiching a structural plate washer between them. The structural nut of the present invention is designed to serve as the lower nut for a double-nut and plate washer anchorage. By avoiding welding the nut to the chair the structural integrity of the nut is better preserved, and the process does not need to include a welding station. Welding can crack nuts, especially if they are heat treated.

It is also an object of the present invention to provide an anchor bolt locator where the connection between the threaded rod and the locator is easily made. This object is achieved by providing a central opening in the anchor bolt chair that allows the user to precisely position the anchor bolt locator, while also providing tongues that serve as stop to prevent the anchor from being inserted too far into the structural nut. The threaded rod is rotated into the nut and tongues or prongs stop the threaded rod from being inserted farther than is necessary into the nut. If the anchor is threaded too far into the nut, the bottom of the anchor may be placed too close to the bottom of the concrete form which can lead to degradation of the anchor, and it will also mean that less of the anchor protrudes from the top of the form for attaching other devices.

BRIEF DESCRIPTION OF THE DRAWINGS

FIG. 1A is a perspective view of the anchor bolt locator of the present invention.

FIG. 1B is an alternate perspective view of the anchor bolt locator of the present invention.

FIG. 1C is an exploded, perspective view of the anchor bolt locator of the present invention, showing the placement of fasteners to secure the anchor bolt locator.

DETAILED DESCRIPTION OF THE INVENTION

Figure 1D:
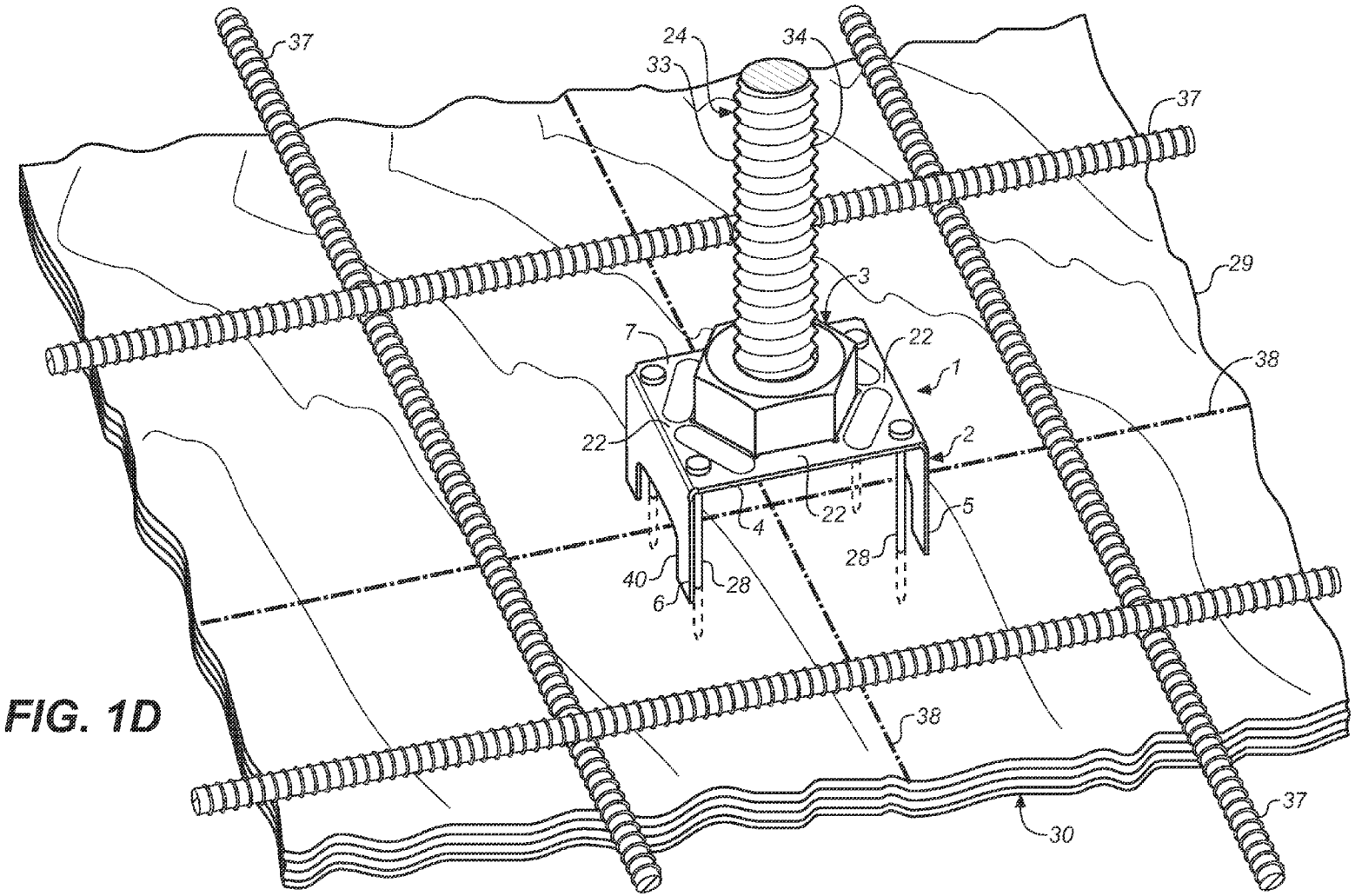
FIG. 1D is a perspective view of the anchor bolt locator of the present invention, attached to and set in a concrete slab form.

FIG. 1A, shows the preferred, non-welded anchor bolt locator 1 of the present invention made from a galvanized sheet metal chair 2 and a structural nut 3 attached to the chair 2 by way of a friction fit.

As shown in FIG. 1A, preferably the chair 2 of the anchor bolt locator 1 is a u-shaped body having a bridge 4 that connects two legs 5 and 6. Preferably, the bridge 4 is substantially rectangular with pairs of opposed sides and the legs 5 and 6 of the chair 2 are connected to the bridge 4 at one pair of opposed sides. Preferably, the legs 5 and 6 of the chair 2 depend from the bridge 4 at right angles to the bridge 4. Preferably, the plurality of legs 5 and 6 extend away from the top surface 7 of the of the bridge 4.

Figure 1E:
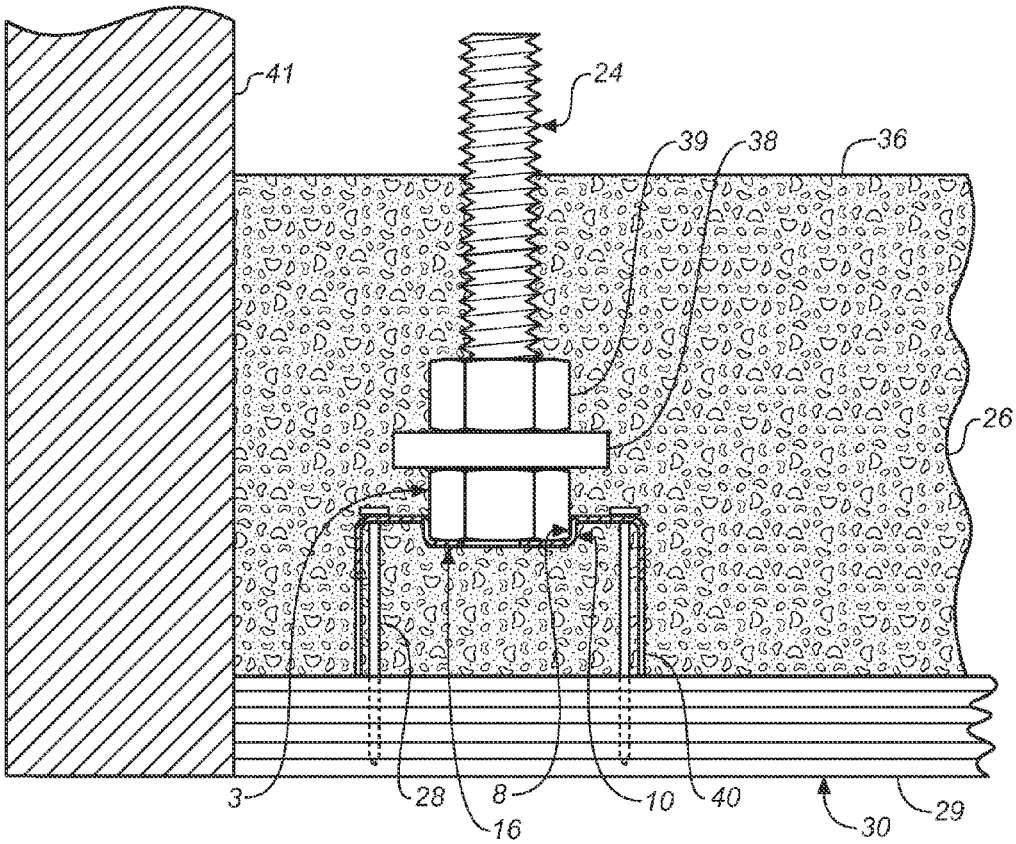
FIG. 1E is a side view of the anchor bolt locator of the present invention, attached to and set in a concrete slab form, showing the concrete in the form.
Figure 2A:
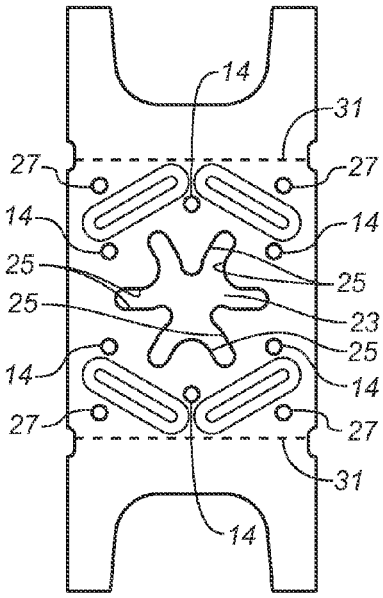
FIG. 2A is a plan view of the blank of the chair of an anchor bolt locator of the present invention.
Figure 2B:
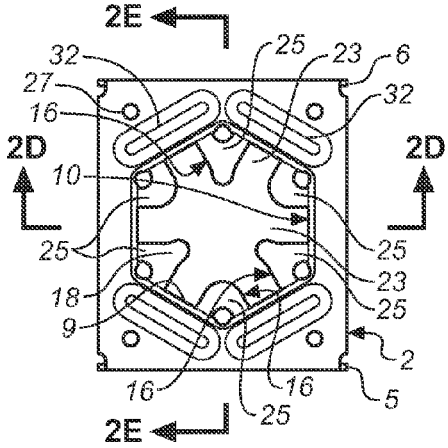
FIG. 2B is a plan view of a chair of an anchor bolt locator of the present invention, after openings have been cut in the chair, and the depression and the legs bent from the bridge of the chair.
Figure 2D:
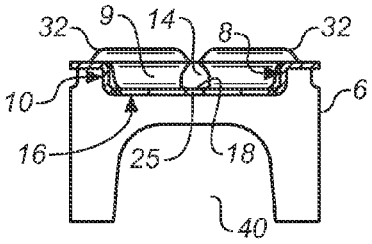
FIG. 2D is a sectional view of a chair of an anchor bolt locator of the present invention taken along line 2D-2D of FIG. 2B.
Figure 2C:
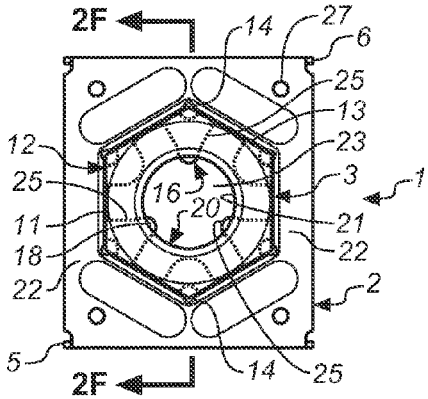
FIG. 2C is a plan view of an anchor bolt locator of the present invention. The structural nut has been attached to the chair.

As shown in FIGS. 1E and 2D-2F, the bridge 4 is formed with a depression 8 that receives the structural nut 3. The structural nut 3 is connected to the bridge 4 by frictional engagement and is held securely in place. The inner surface 9 of the side wall 10 of the depression 8 in the bridge 4 frictionally engages with the outer surface 11 of the outer side wall 12 of the nut 3. Preferably, the outer side surface 11 of the nut 3 is made with flat faces 13 to have a polygonal, preferably hexagonal, cross-section. As shown in FIGS. 1B, 2C and 2D, edge openings 14 may be formed in the side wall 10 of the depression 8 where the flat faces 13 of the outer surface 11 of the polygonal nut 3 meet at nut side edges 15. These edge openings 14 are particularly needed when a deep depression 8 must be made for a tall structural nut 3, and the metal of the side walls 10 must be particularly stretched to make the depression 8. The edge openings 14 may also be formed in the side wall 10 to extend into the bottom floor 16 of the depression 8 where the nut side edges 15 meet the bottom end 17 of the nut. The side wall 10 of the depression 8 extends away from the top surface 7 of the bridge 4.

Figure 2E:
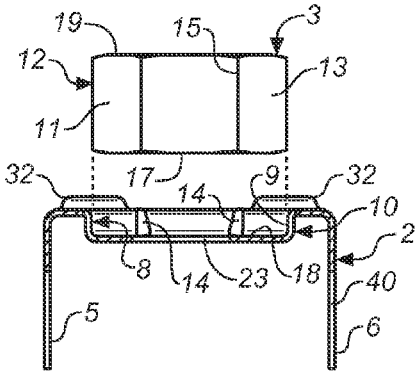
FIG. 2E is a sectional view of a chair of an anchor bolt locator of the present invention taken along line 2E-2E of FIG. 2B, with a structural nut shown above the chair and ready for placement in the chair.
Figure 2F:
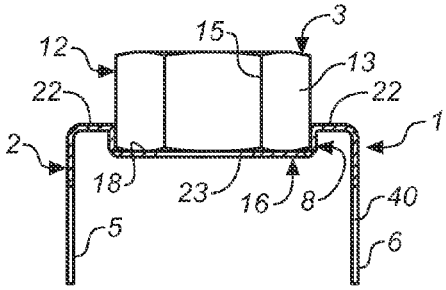
FIG. 2F is a partial sectional view of an anchor bolt locator of the present invention similar to FIG. 2E, with the structural nut now set in place on the chair, and the chair having been modified to frictionally engage the nut, securing it in place.
Figure 3A:
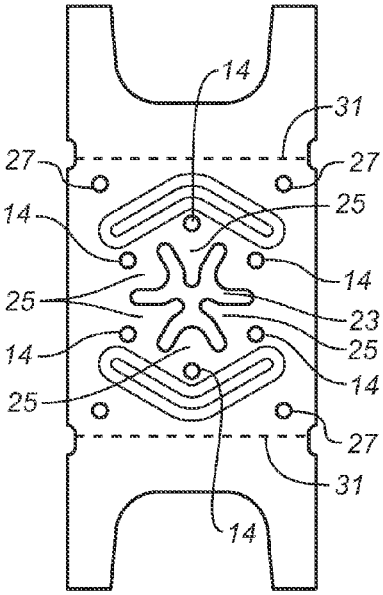
FIG. 3A is a plan view of a blank of a chair of an anchor bolt locator of the present invention. The anchor bolt locator shown in FIGS. 3A-3F is similar to the anchor bolt locator shown in FIGS. 2A-2F, except the anchor bolt locator shown in FIGS. 3A-3F receives a smaller structural nut.
Figure 3B:
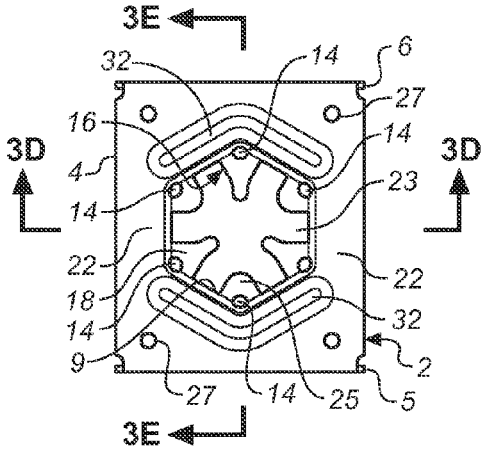
FIG. 3B is a plan view of a chair of an anchor bolt locator of the present invention, after openings have been cut in the chair, and the depression and the legs bent from the bridge of the chair.
Figure 3D:
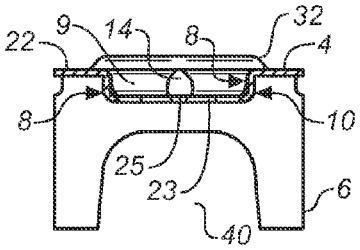
FIG. 3D is a sectional view of the chair of the anchor bolt locator of the present invention taken along line 3D-3D of FIG. 3B.
Figure 3C:
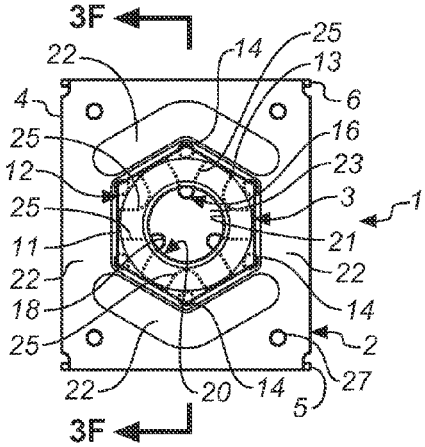
FIG. 3C is a plan view of the anchor bolt locator of the present invention. The structural nut has been attached to the chair.
Figure 3E:
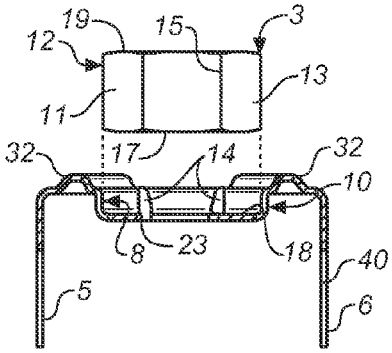
FIG. 3E is a sectional view of the chair of the anchor bolt locator of the present invention taken along line 3E-3E of FIG. 3B, with the structural nut shown above the chair and ready for placement in the chair.
Figure 3F:
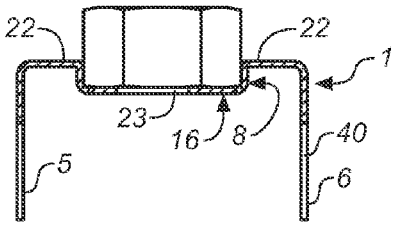
FIG. 3F is a partial sectional view of the anchor bolt locator of the present invention similar to FIG. 3E, with the structural nut now set in place on the chair, and the chair having been modified to frictionally engage the nut, securing it in place.
Figure 4A:
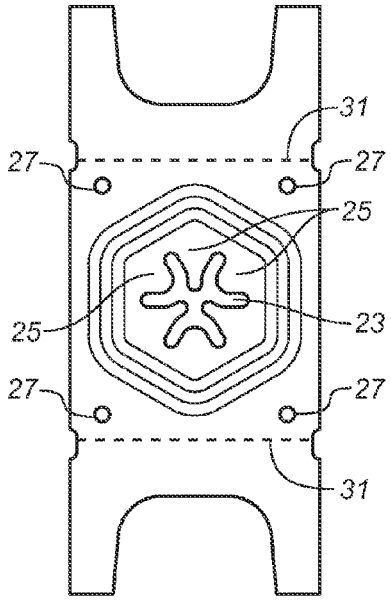
FIG. 4A is a plan view of a blank of a chair of an anchor bolt locator of the present invention. The anchor bolt locator shown in FIGS. 4A-4F is similar to the anchor bolt locator shown in FIGS. 2A-2F and FIGS. 3A-3F, except the anchor bolt locator shown in FIGS. 4A-4F receives an even smaller structural nut.
Figure 4B:
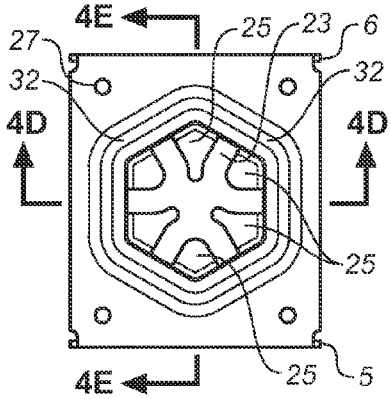
FIG. 4B is a plan view of a chair of an anchor bolt locator of the present invention, after openings have been cut in the chair, and the depression and the legs bent from the bridge of the chair.
Figure 4D:
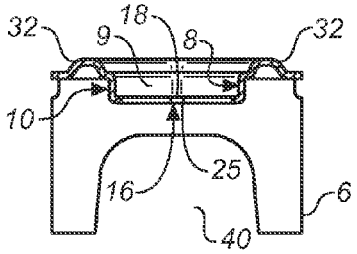
FIG. 4D is a sectional view of the chair of the anchor bolt locator of the present invention taken along line 4D-4D of FIG. 4B.
Figure 4C:
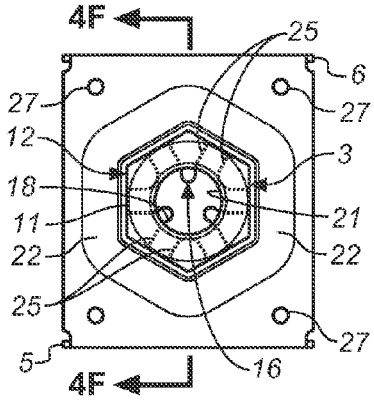
FIG. 4C is a plan view of the anchor bolt locator of the present invention. The structural nut has been attached to the chair.
Figure 4E:
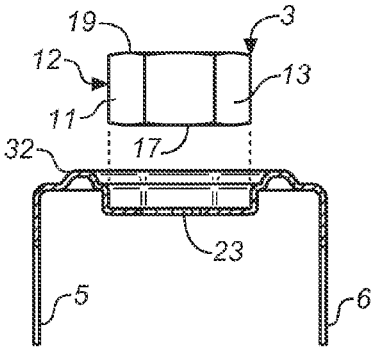
FIG. 4E is a sectional view of the chair of the anchor bolt locator of the present invention taken along line 4E-4E of FIG. 4B, with the structural nut shown above the chair and ready for placement in the chair.
Figure 4F:
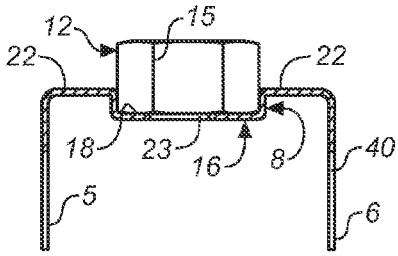
FIG. 4F is a partial sectional view of the anchor bolt locator of the present invention similar to FIG. 4E, with the structural nut now set in place on the chair, and the chair having been modified to frictionally engage the nut, securing it in place.
Figure 5A:
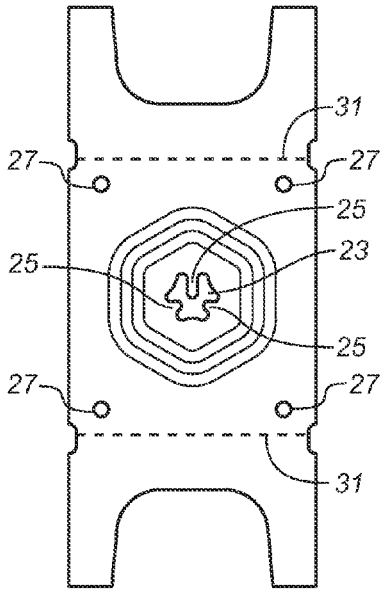
FIG. 5A is a plan view of a blank of a chair of an anchor bolt locator of the present invention. The anchor bolt locator shown in FIGS. 5A-5F is similar to the anchor bolt locator shown in FIGS. 2A-2F, FIGS. 3A-3F and FIGS. 4A-4F, except the anchor bolt locator shown in FIGS. 5A-5F receives an even smaller structural nut.
Figure 5B:
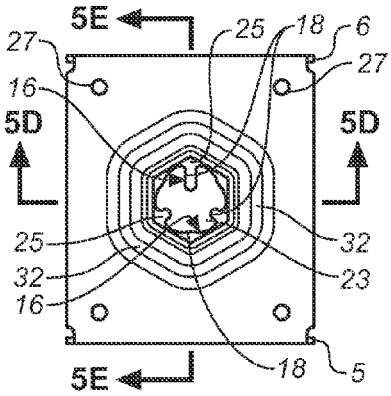
FIG. 5B is a plan view of a chair of an anchor bolt locator of the present invention, after openings have been cut in the chair, and the depression and the legs bent from the bridge of the chair.
Figure 5D:
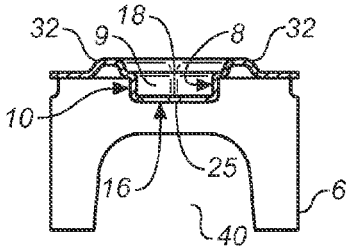
FIG. 5D is a sectional view of the chair of the anchor bolt locator of the present invention taken along line 5D-5D of FIG. 5B.
Figure 5C:
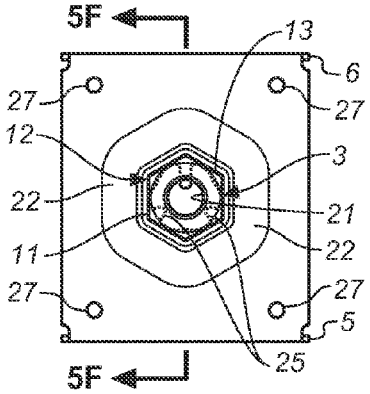
FIG. 5C is a plan view of the anchor bolt locator of the present invention. The structural nut has been attached to the chair.
Figure 5E:
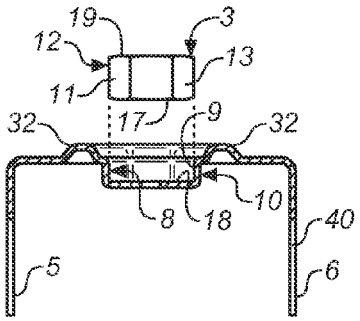
FIG. 5E is a sectional view of the chair of the anchor bolt locator of the present invention taken along line 5E-5E of FIG. 5B, with the structural nut shown above the chair and ready for placement in the chair.
Figure 5F:
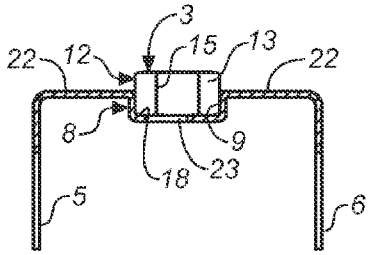
FIG. 5F is a partial sectional view of the anchor bolt locator of the present invention similar to FIG. 5E, with the structural nut now set in place on the chair, and the chair having been modified to frictionally engage the nut, securing it in place.

As shown in FIGS. 2B and 2C, the depression 8 in the bridge 4 is formed with a bottom floor 16 that has a top surface 18. As shown in FIGS. 1A-1E, the structural nut 3 is received in the depression 8 of the bridge 4. As best shown in FIGS. 2C and 2E, the structural nut 3 has a top end 19, a bottom end 17, an internal, threaded bore 20 forming an internal, threaded side wall 21, and an outer side wall 12 defining an outer surface 11 of the nut 3. The bottom end 17 of the structural nut 3 rests on the top surface 18 of the bottom floor 16 of the depression 8, and portions of the outer surface 11 of the outer side wall 12 of the structural nut 3 are in contact with and in frictional engagement with portions of the inner surface 9 of the side wall 10 of the depression 8 such that the structural nut 3 is secured to the chair 2.

As shown in FIGS. 1A and 2E, preferably, the outer side wall 12 of the nut 3 extends at a right angle to the top and bottom ends 19 and 17 of the nut 3. Preferably, the side wall 10 of the depression 8 in the bridge 4 extends at right angle to the generally planar portion 22 of the bridge 4 surrounding the depression, and the generally planar portion 22 of the bridge 4 surrounding the depression 8 extends at a right angle to the outer side wall 12 of the structural nut 3.

Since the anchor bolt locator 1 is preferably made from thin sheet steel the bridge 4 and legs 5 and 6 are, preferably, generally planar, thin members. See FIGS. 2C and 2F. Preferably, a portion 22 of the bridge 4 surrounding the depression 8 in the bridge of the chair 2 is a substantially planar and relatively thin member. As such, the structural nut 3 between the top end 19 and the bottom end 17 will have a thickness that is substantially greater than the relatively thin portion 22 of the bridge 4 surrounding the depression 8. Similarly, the depression 8 in the bridge 4 to accommodate the structural nut 3 will have a depth from the top surface 7 of the bridge 4 to the bottom floor 16 of the depression 8, with portions of the side wall 10 of the depression 8 extending from the top surface 7 of the bridge to the bottom floor 16 of the depression 8, and that depth of the depression 8 will be substantially greater than the relatively thin portion 22 of the bridge 4 surrounding the depression 8.

As shown in FIGS. 1B and 2B, preferably, the depression 8 in the bridge 4 of the anchor bolt locator 1 is formed with an opening 23 in the bottom floor 16. Preferably, the opening 23 is located at the center of the depression 8 and will align with the center of the internal bore 20 in the nut 3. This allows for accurate placement of the anchor or threaded rod 24. The opening 23 is preferably an irregular opening 23 that creates a plurality of tongues 25 that extend underneath and support the structural nut 3 at is bottom end 17. Preferably, at least one of the tongues 25 that make up the bottom floor 16 of the depression 8 extends sufficiently inward from the side walls 10 of the depression 8 to extend past the internal side wall 21 of the structural nut 3, so as to block the passage created by the internal bore 20 so as to interfere and stop the travel of any threaded rod or anchor 24 received and threaded into the internal passage 20 of the nut 3 past the bottom end 17 of the structural nut 3.

As shown in FIGS. 1A and 1E, each leg 5 and 6 of the chair 2 is formed with a flow passage 40 to ensure that concrete 26 flows around and under the anchor bolt locator 1 and the threaded rod 24 attached to the nut 3.

Mounting holes 27 are provided in the bridge 4, preferably at all four corners of the bridge 4. As shown in FIGS. 1C, 1D and 1E, fasteners 28, preferably nails when the form board bottom 29 is wood, are inserted through the mounting holes 27 and fastened to the form board decking 29, securing the anchor bolt locator 1 to the form 30 in the desired location.

The anchor bolt locator 1 is preferably formed from galvanized, stainless-steel formed in a sheet. Steel is sufficiently rigid, and can be cold-formed to grip the structural nut 3 after it has been placed in the depression 8. In the preferred method of making the anchor bolt locator 1, any openings that are to be made in the bridge 4 are formed first, usually with or right after the blank for the chair 2 is cut from the sheet stock. See FIGS. 2A, 3A, 4A and 5A. Then, the depression 8 in the bridge 4 for receiving the nut 3 is formed and the legs 5 and 6 are bent down from the bridge 4 along bend lines 31. See FIGS. 2B, 2D, 3B, 3D, 4B, 4D and 5B, 5D. At the same time, embossments 32 are formed in the bridge 4 outwardly from the depression 8. The depression 8 of the chair 2 is then ready to receive the nut 3 which is placed in the depression 8. See FIGS. 2E, 3E, 4E and 5E. The structural nut 3 is placed in the depression 8 so that portions of the outer surface 11 of the outer side wall 12 of the structural nut 3 are in alignment and in close proximity to portions of the inner surface 9 of the side wall 10 of the depression 8. Once the nut 3 is received the embossments 32 formed outwardly from the depression 8 are clampingly pressed back into the original plane of the bridge 4 of the chair 2. See FIGS. 2C, 2F, 3C, 3F, 4C, 4F and 5C, 5F. This causes a spreading flow of the material of the embossments 32 toward the depression 8 which causes the side walls 10 of the depression 8 to be pressed against the outer side surface 11 of the nut 3, causing frictional engagement that holds the structural nut 3 in place.

As shown in FIGS. 1B and 1C, preferably, the attachment between the anchor 24 and the nut 3 is made by means of corresponding threads in the internal cavity 20 of the structural nut 3 and threads 33 on the outer surface 34 of the anchor 24. As shown in FIG. 1E, the anchor 24 is formed with an elongated shank 35 that can protrude above the top level 36 of the concrete slab 26. FIG. 1E shows the top level 36 of the form 30, and the side wall 41 of the form 30.

FIGS. 1D and 1E illustrate use of the invention. The anchor bolt locator 1 shown is used with a wood form 30 upon which concrete 26 will be poured. In FIG. 1D, rebar members 37, a specific type of steel concrete reinforcing member, are shown placed in the form 30. In FIG. 1D, chalk lines 38 are also shown on the bottom member 29 of the form 30 to aid in locating the anchor bolt locator 1. The installer need merely look through the opening 20 in the nut 3 and line up the center of the opening 20 with the intersection of the chalk lines 38. The installer then nails or screws the anchor bolt locator 1 to the bottom 29 of the form 30 by running the fasteners 28 through the mounting holes 27 in the anchor bolt locator 1. Once the anchor bolt locator 1 is firmly fastened to the bottom 29 of the formwork 30, the appropriate anchor 24 or threaded rod is inserted and threaded onto the nut 3, until the tongues 25 of the depression 8 stop its further downward travel. As shown in FIG. 1E, typically a washer 38 will then be placed over the anchor 24 so that it rests on the top surface 19 of the structural nut 3 and a second structural nut 39 will be threaded onto the anchor 24 so that it engages the top surface of the washer 38. This type of double-nut-washer anchorage is commonly used in the industry, because the components are readily available and inexpensive, and yet well documented for their performance as anchors. Concrete 26 is then poured into the formwork 30, so that the anchor bolt locator 1, the structural nuts 3 and 39, the washer 38, and the threaded rod 24 are all surrounded and embedded in the concrete 26 with the top of the threaded rod 24 or anchor protruding from the top surface 36 of the concrete 26. When the concrete 26 hardens the form 30 can be removed. If there is access to the bottom 29 of the form 30, it can be removed as well and the ends of the fasteners 28 that were driven into the bottom formwork 29 can be broken off where they protrude from the concrete foundation 26.

We claim:

1. A connection between an anchor and a cement formwork by an anchor bolt locator, said connection comprising:

a. said cement formwork, having one or more side walls and a bottom, said bottom having a top surface, b. the anchor bolt locator attached to said top surface of said bottom, said anchor bolt locator, including:

1. a chair, having a plurality of legs, a bridge connecting the legs, said bridge having a top surface, with the plurality of legs extending from the bridge in the same direction away from said top surface of said bridge, said plurality of legs resting on said top surface of said bottom of said cement formwork
2. a depression formed in the bridge of the chair, the depression having a side wall with an inner surface, the side wall extending away from the top surface of the bridge, the depression also having a bottom floor with a top surface,
3. a structural nut received in the depression of the bridge, the structural nut having a top end, a bottom end, an internal bore forming an internal side wall, said structural nut also having an outer side wall defining an outer surface of said nut, wherein, the bottom end of the structural nut rests on the top surface of the bottom floor of the depression, and portions of the outer surface of the outer side wall of the structural nut are in contact with and in frictional engagement with portions of the inner surface of the side wall of the depression such that the structural nut is secured to the chair;

c. a plurality of fasteners inserted through mounting openings in said bridge of said anchor bolt locator and inserted into said bottom of said cement formwork, such that said anchor bolt locator is firmly secured to said bottom; and d. said anchor is received in said internal bore of said structural nut.

2. The connection of claim 1, wherein:

said bottom floor of said depression extends inwardly past the internal side wall of the internal bore of the structural nut and contacts said anchor preventing it from moving past said bottom floor of said depression.

3. The connection of claim 1, wherein:

said bottom floor of said depression is made with an opening.

4. The connection of claim 1, wherein:

said anchor bolt locator is formed so that a portion of said bridge surrounding said depression in said bridge of said chair is a substantially planar and relatively thin member.

5. The connection of claim 4, wherein:

said anchor bolt locator is formed so that said structural nut between said top end and said bottom end has a thickness that is substantially greater than said relatively thin portion of said bridge surrounding said depression.

* * * * *